US005381204A

United States Patent [19]

Grusetski et al.

[11] Patent Number: 5,381,204

[45] Date of Patent: Jan. 10, 1995

[54] LEADER CARD ATTACHABLE TO A PHOTOGRAPHIC FILMSTRIP HAVING A LEAD END WITH AT LEAST ONE APERTURE

[75] Inventors: Rodney J. Grusetski, Kendall; Robert J. Blackman, Rochester, both of N.Y.

[73] Assignee: Eastman Kodak Company, Rochester, N.Y.

[21] Appl. No.: 112,159

[22] Filed: Aug. 26, 1993

[51] Int. Cl.[6] ..... G03D 13/10

[52] U.S. Cl. ..... 354/345; 352/235; 354/339

[58] Field of Search ..... 354/319–323, 354/339, 354; 226/91–93; 242/74, 74.1, 195; 352/235

[56] References Cited

U.S. PATENT DOCUMENTS

| | | | |
|---|---|---|---|
| 1,655,297 | 1/1928 | Thornton | 352/235 |
| 3,462,054 | 8/1969 | Foor | 226/91 |
| 3,724,776 | 4/1973 | McKee | 242/195 |
| 4,065,042 | 12/1977 | Zielinski | 226/92 |
| 4,110,774 | 8/1978 | Krehbiel et al. | 354/345 |
| 4,140,383 | 2/1979 | Schmidt | 354/316 |
| 4,239,367 | 12/1980 | Hope et al. | 354/319 |
| 4,572,460 | 2/1986 | Hertrich | 242/195 |
| 4,662,554 | 5/1987 | Yamazaki et al. | 226/170 |
| 5,015,089 | 5/1991 | Radov | 352/235 |

FOREIGN PATENT DOCUMENTS 859741 12/1990 Japan .

*Primary Examiner*—D. Rutledge

*Attorney, Agent, or Firm*—David A. Hawley

[57] ABSTRACT

A leader card attachable to a photographic filmstrip having a lead end with at least one aperture. The leader card includes (1) a piece of material having a tab portion and (2) at least one hook secured to the material. The hook is sized to be extendible through the aperture to secure the leader card and lead end of the filmstrip together. The tab portion inhibits the hook from being removed from the aperture.

13 Claims, 2 Drawing Sheets

LEADER CARD ATTACHABLE TO A PHOTOGRAPHIC FILMSTRIP HAVING A LEAD END WITH AT LEAST ONE APERTURE

CROSS-REFERENCE TO RELATED APPLICATION

Reference is made to commonly assigned copending application Ser. No. 08/080,793, entitled "A Leader Card Attachable to a Photographic Filmstrip Having a Lead End with a Pair of Apertures", and filed Jun. 22, 1993 in the name of Francis C. Long, which is assigned to the assignee of the present Application.

FIELD OF THE INVENTION

This invention relates generally to the field of photography, and, more particularly, to photofinishing. Specifically, the invention relates to a leader card which is attachable to a photographic filmstrip having a lead end with at least one aperture.

BACKGROUND OF THE INVENTION

After a customer has exposed a roll of photographic film, the customer takes the film to a photofinisher to obtain photographs of the images captured on the film. In order to develop the film, the photofinisher passes the filmstrip through a series of liquid baths which typically include a developer, a bleach/fix and a stabilizer. The film is then dried and used to create photographs.

One method of passing the film through the various baths is to attach a leader card to the lead end of the film and pull the leader card through the baths. As the leader card is pulled through the baths, the film is towed behind the leader card and is therefore exposed to the baths.

An example of such a leader card is disclosed in U.S. Pat. No. 4,110,774 which issued in the name of Krehbiel et al. on Aug. 29, 1978. Krehbiel et al. discloses a film guide for inserting into a film processor and guiding a roll of undeveloped film therethrough. The guide includes an elongated flexible leader having a tongue which extends outwardly from the rear of the leader. The tongue has a neck portion which is narrower than the rest of the tongue. An aperture in the film has a width greater than the neck width of the tongue. The tongue width is greater than the aperture width but less than the aperture length. The end of the tongue is inserted perpendicular to the length of the film into the aperture. The leader is then pivoted so that the leader is parallel to the length of the film. Such an arrangement allows the film to pivot relative to the leader as the film is guided through the film processor.

PROBLEMS TO BE SOLVED BY THE INVENTION

In Krehbiel et al., if the leader and film are pivoted at too great an angle during film processing, the tongue may be pulled out of the film aperture, thereby stranding the film inside the film processor. This occurs because the tongue extends in a direction opposite to the direction in which the leader card is pulled.

SUMMARY OF THE INVENTION

According to one aspect of the invention, a leader card is provided which is attachable to a photographic filmstrip having a lead end with at least one aperture. The leader card includes (1) a piece of material having a tab portion and (2) at least one hook secured to the material. The hook is sized to be extendible through the aperture to secure the leader card and lead end of the filmstrip together. The tab portion is capable of inhibiting the hook from being removed from the aperture.

ADVANTAGEOUS EFFECT OF THE INVENTION

In the present invention, the hook extends in the same direction in which the leader card is pulled. As a result, the hook cannot come loose from the film aperture even when the leader and film are pivoted relative to each other.

DETAILED DESCRIPTION OF THE INVENTION

Figure 1:
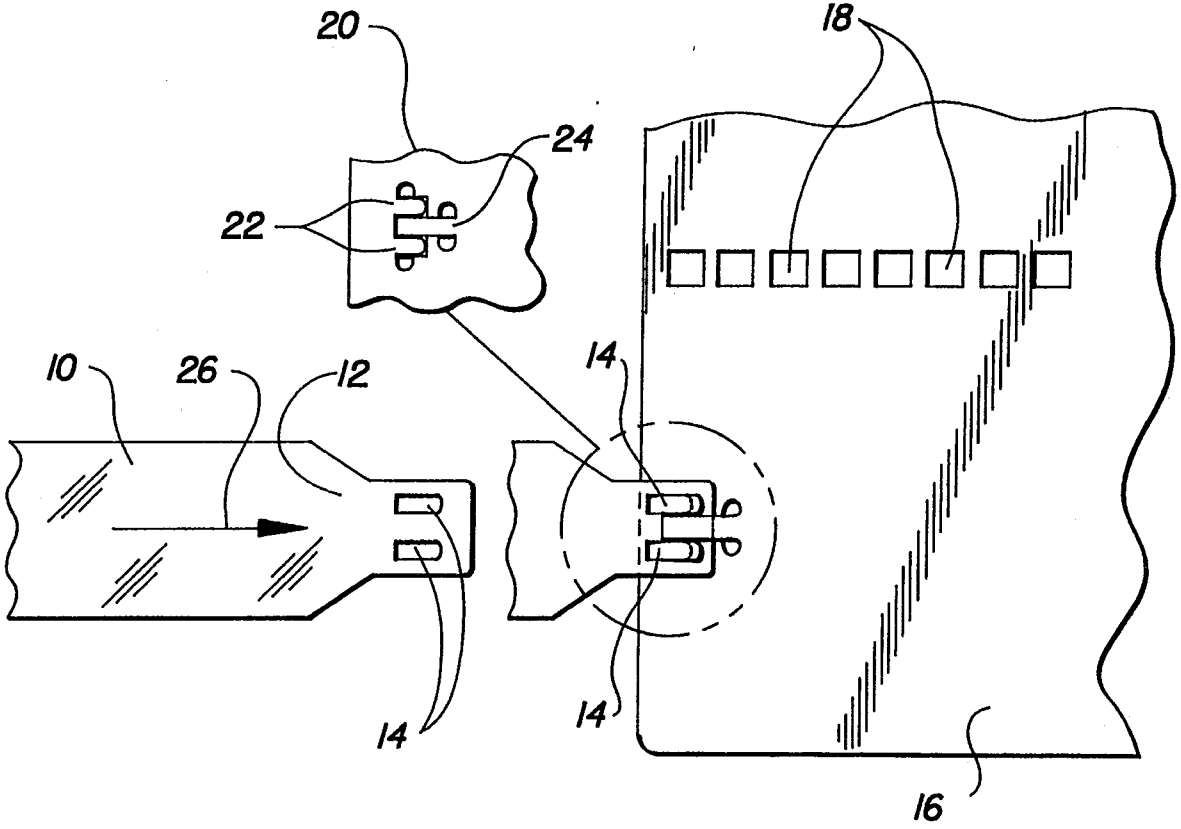
FIG. 1 is a top view of a first embodiment of a portion of a leader card and of a filmstrip leading end.

Referring now to the drawings, FIG. 1 shows a photographic filmstrip 10 having a lead end 12. The lead end of the filmstrip is the end that enters a photofinishing apparatus first, even though this lead end may have exited its associated film cartridge last. Lead end 12 has a pair of apertures 14. A leader card 16 has a series of apertures 18 which are engageable by, for example, gear teeth in a film processor to pull the leader card through the film processor. The leader card is preferably made of a flat sheet of material such as plastic or mylar.

Leader card 16 includes a certain geometry 20 which is utilized to secure filmstrip 10 to leader card 16. Geometry 20 can be formed when the leader card is created or may be formed after the leader card is created by the use of a hand-held punch. Geometry 20 includes a pair of hooks 22 and a tab portion 24. Hooks 22 are sized to be extendible through apertures 14. Hooks 22 and tab portion 24 are preferably parallel with each other and extend in opposite directions. Part of tab portion 24 extends between hooks 22.

In order to connect filmstrip 10 and leader card 16, filmstrip 10 is moved in the direction of an arrow 26 such that the filmstrip and leader card are moved towards each other. Tab 24 is bent up (out of the plane in which FIG. 1 is located) so that the lead end 12 of the filmstrip can be slid under tab portion 24 and over hooks 22. The above is accomplished such that the hooks are essentially aligned with apertures 14. Filmstrip 10 and leader card 16 are then moved away from each other such that hooks 22 extend respectively up through apertures 14. The natural springiness of tab portion 24 causes the tab portion to press down on lead end 12, causing lead end 12 to be pinched between tab portion 24 and leader card 16. This pinching effect inhibits hooks 22 from being removed from apertures 14 with the result that filmstrip 10 is secured to leader card 16.

Figure 2:
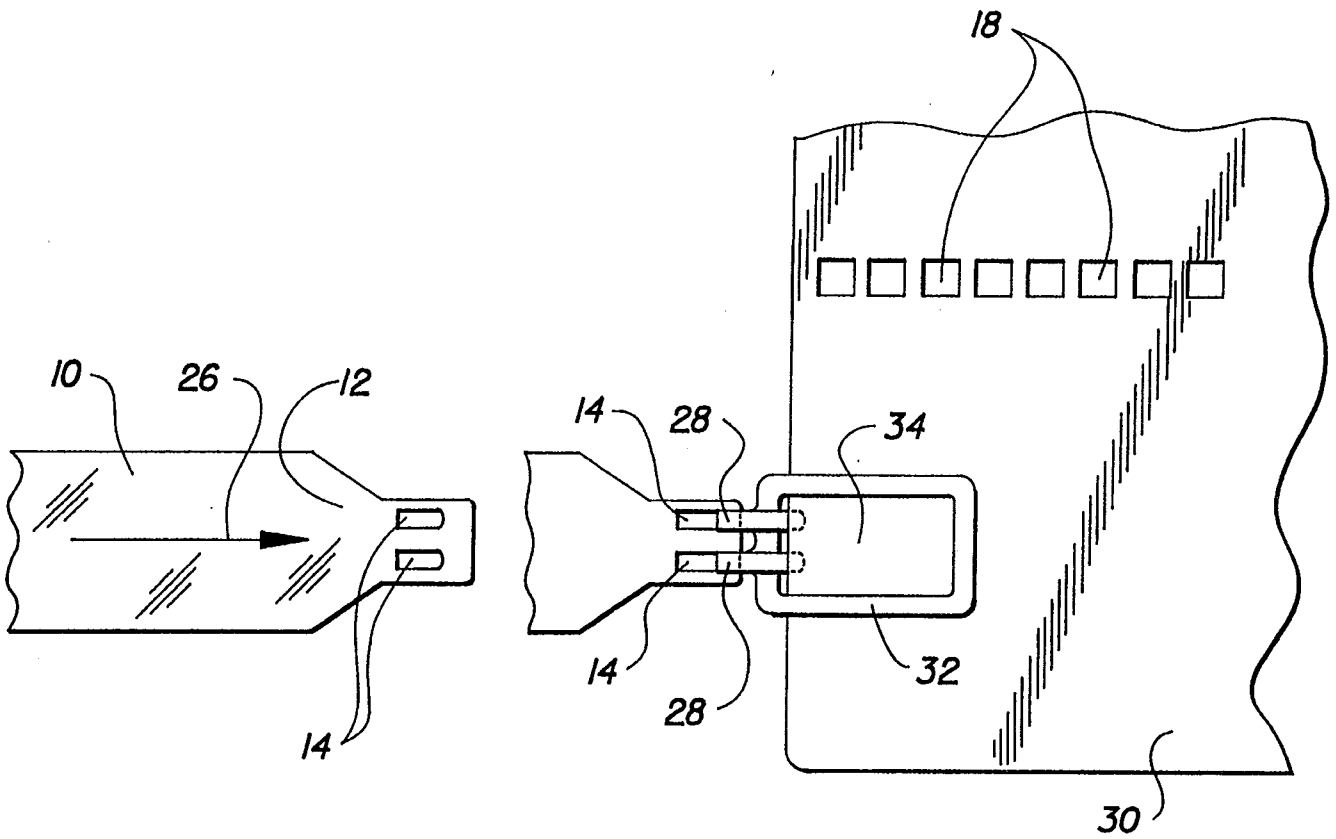
FIG. 2 is a top view of a second embodiment of a portion of a leader card and of a filmstrip leading end.

Turning now to FIG. 2, another embodiment of the present invention is shown. In this embodiment, filmstrip 10 is essentially the same as in FIG. 1. However, rather than forming the hooks from the leader card, hooks 28 are secured to leader card 30 by, for example, gluing a body portion 32 of the hooks to leader card 30. Such an arrangement allows an existing leader card to be modified such that it can be connected to lead end 12 without having to physically alter the leader card.

Hooks 28 differ from hooks 22 in that hooks 28 initially extend towards filmstrip 10 then bend back to extend away from the filmstrip. In order to secure leading end 12 of filmstrip 10 to leader card 30, hooks 28 are inserted up through apertures 14. The lead portion of each hook 28 is tucked under a tab portion 34 of leader card 30 to inhibit hooks 28 from being removed from apertures 14.

Although particular embodiments of the invention have been described and illustrated herein, it is recognized that modifications and variations may readily occur to those skilled in the art and consequently it is intended that the claims be interpreted to cover such modifications and equivalents.

PARTS LIST FOR FIGS. 1–2

10 Filmstrip
12 Lead End
14 Apertures
16 Leader Card
18 Apertures
20 Geometry
22 Hooks
24 Tab Portion
26 Arrow
28 Hooks
30 Leader Card
32 Body Portion
34 Tab Portion

What is claimed is:

1. A combination of a leader card and a lead end of a photographic filmstrip for use in a photofinishing apparatus, comprising:

a leader card having a tab portion and a pair of hooks, said tab portion and said pair of hooks being essentially parallel with each other; and a lead end of a photographic filmstrip, said lead end having a pair of apertures, said pair of hooks being sized to extend respectively through said pair of apertures to secure the leader card and lead end of the filmstrip together, said tab portion inhibiting said hooks from being removed from said aperture.

2. The combination of claim 1, wherein said tab portion extends in a first direction and said pair of hooks extend in a second direction essentially opposite from said first direction.

3. The combination of claim 1, wherein part of said tab portion extends between said pair of hooks.

4. The combination of claim 1, wherein a portion of each hook is tucked under said tab portion to inhibit said hooks from being removed from said apertures.

5. The combination of claim 1, wherein said tab portion and said hooks are formed from said leader card.

6. The combination of claim 1, wherein said tab portion is formed from said leader card and wherein said hooks are attached to said leader card.

7. A leader card attachable to a photographic filmstrip having a lead end with a pair of apertures, the leader card comprising:

a piece of material having a tab portion; and a pair of hooks secured to said material, said tab portion and said pair of hooks being essentially parallel with each other, said pair of hooks being sized to be respectively extendible through said pair of apertures to secure the leader card and lead end of the filmstrip together, said tab portion being capable of inhibiting said pair of hooks from being removed from said pair of apertures.

8. The leader card of claim 7, wherein said tab portion extends in a first direction and said pair of hooks extend in a second direction essentially opposite from said first direction.

9. The leader card of claim 7, wherein a portion of said tab portion extends between said pair of hooks.

10. The combination of claim 7, wherein a portion of each hook can be tucked under said tab portion to inhibit said hooks from being removed from said apertures.

11. The combination of claim 7, wherein said tab portion and said hooks are formed from said leader card.

12. The combination of claim 1, wherein said tab portion is formed from said leader card and wherein said hooks are attached to said leader card.

13. A method of connecting a leader card, having a tab portion and at least one hook, and a lead end of a photographic filmstrip having at least one aperture, said method comprising the steps of:

moving said leader card and said filmstrip lead end towards each other such that said hook is essentially aligned with said aperture;

moving said leader card and said filmstrip lead end away from each other such that said hook extends through said aperture and said tab portion inhibits said hook from being removed from said aperture, thereby securing the leader card and lead end of the filmstrip together; and tucking a portion of said hook under said tab portion to inhibit said hook from being removed from said aperture.

* * * * *

UNITED STATES PATENT AND TRADEMARK OFFICE

CERTIFICATE OF CORRECTION

PATENT NO. : 5,381,204

DATED : January 10, 1995

INVENTOR(S) : Rodney J. Grusetski, et al

It is certified that error appears in the above-indentified patent and that said Letters Patent is hereby corrected as shown below:

Column 3, line 46, delete "aperture" and insert --apertures--.

Column 4, line 34, delete "1" and insert --7--.

Signed and Sealed this

Fourteenth Day of March, 1995

Bruce Lehman

*Attest:*

BRUCE LEHMAN

*Attesting Officer*

*Commissioner of Patents and Trademarks*